US007479868B2

(12) United States Patent
Rose

(10) Patent No.: US 7,479,868 B2
(45) Date of Patent: Jan. 20, 2009

(54) TRIP-FREE MANUAL RESET THERMOSTAT

(75) Inventor: Derek Rose, Mansfield, OH (US)

(73) Assignee: Therm-O-Disc, Incorporated, Mansfield, OH (US)

( * ) Notice: Subject to any disclaimer, the term of this patent is extended or adjusted under 35 U.S.C. 154(b) by 263 days.

(21) Appl. No.: 11/147,478

(22) Filed: Jun. 8, 2005

(65) Prior Publication Data

US 2006/0279397 A1 Dec. 14, 2006

(51) Int. Cl.
*H01H 71/16* (2006.01)
*H01H 37/52* (2006.01)
*H01H 37/74* (2006.01)
*H01H 3/12* (2006.01)

(52) U.S. Cl. ..... 337/348; 337/333; 337/334; 337/354; 337/66; 200/341

(58) Field of Classification Search ..... 337/312, 337/348, 333–334, 107, 354, 367, 56, 91, 337/66; 200/520, 341, 334
See application file for complete search history.

(56) References Cited

U.S. PATENT DOCUMENTS 2,300,530 A * 11/1942 Swingle ..... 337/69
2,461,338 A * 2/1949 Miller ..... 337/60
2,473,901 A * 6/1949 Lawrence ..... 337/74
2,591,802 A * 4/1952 Garner ..... 337/311
2,646,479 A * 7/1953 Ashe ..... 337/57
2,659,788 A * 11/1953 Casey ..... 337/60
2,694,121 A * 11/1954 Vander Ply ..... 337/41
2,704,312 A * 3/1955 Mang ..... 337/91
2,714,644 A 8/1955 Harrison ..... 200/138
2,844,778 A * 7/1958 Seely et al. ..... 361/32
3,164,702 A 1/1965 Ruckriegel et al. ..... 200/138
3,211,862 A * 10/1965 Ellenberger ..... 337/47
3,219,783 A 11/1965 Odson ..... 200/138
3,272,946 A * 9/1966 Manecke ..... 337/391
3,428,932 A 2/1969 Manecke ..... 337/348
3,435,189 A * 3/1969 Manecke ..... 392/454
3,451,016 A * 6/1969 Ellenberger ..... 335/23
3,470,517 A * 9/1969 Them et al. ..... 337/348
3,675,178 A * 7/1972 Place ..... 337/348
3,708,776 A * 1/1973 Ellenberger ..... 337/66
3,720,899 A * 3/1973 Hire et al. ..... 337/348
3,885,222 A * 5/1975 Manecke ..... 337/338
4,039,991 A 8/1977 Bucheister ..... 337/348
4,053,859 A 10/1977 Hollweck ..... 337/91

(Continued)

*Primary Examiner*—Jayprakash N Gandhi
*Assistant Examiner*—Bradley H Thomas
(74) *Attorney, Agent, or Firm*—Harness, Dickey & Pierce, PLC

(57) ABSTRACT

A trip-free manual reset thermostat includes a first fixed contact and a second fixed contact for an electric circuit and a bridging contact having a first end and a second end in contact with the first and second fixed contacts, respectively, in a normally closed position. The bridging contact is tripped open and is not in contact with the first and second fixed contacts at a predetermined higher temperature. When a pushbutton is in a depressed position, the bridging contact is pressed toward the fixed contacts and the second end of the bridging contact is caused to pivot around the first end of the bridging contact. The thermostat does not require a narrow manufacturing and assembly tolerance to achieve a trip-free function and has a simpler structure and is easy to manufacture.

15 Claims, 11 Drawing Sheets

U.S. PATENT DOCUMENTS

| | | | | | |
|---|---|---|---|---|---|
| 4,260,977 | A | * | 4/1981 | Kicherer et al. | 337/318 |
| 4,365,228 | A | * | 12/1982 | Rowley | 337/347 |
| 4,403,206 | A | | 9/1983 | Anderson | 337/348 |
| 4,480,246 | A | | 10/1984 | Schmitt | 337/348 |
| 4,486,735 | A | | 12/1984 | Foster | 337/348 |
| 4,633,211 | A | * | 12/1986 | McIntosh | 337/338 |
| 4,703,301 | A | | 10/1987 | Hollweck et al. | 337/367 |
| 4,758,876 | A | | 7/1988 | Calenda et al. | 357/79 |
| 4,841,271 | A | | 6/1989 | Purssell | 337/320 |
| 5,003,282 | A | | 3/1991 | Boulanger | 337/358 |
| 5,157,370 | A | | 10/1992 | Engelbach et al. | 337/348 |
| 5,270,799 | A | | 12/1993 | Rose | 337/354 |
| 5,491,460 | A | * | 2/1996 | Krasser et al. | 337/70 |
| 5,525,952 | A | | 6/1996 | Rose | 337/60 |
| 5,565,666 | A | | 10/1996 | Kautz | 200/83 |
| 5,685,481 | A | * | 11/1997 | Murphy et al. | 236/21 B |
| 5,703,560 | A | | 12/1997 | Short et al. | 337/348 |
| 5,929,742 | A | | 7/1999 | Short | 337/348 |
| 5,994,987 | A | * | 11/1999 | Passow | 335/78 |
| 6,094,126 | A | | 7/2000 | Sorenson | 337/37 |
| 6,417,756 | B1 | | 7/2002 | Yu | 337/66 |
| 6,483,058 | B2 | | 11/2002 | Ehrensberger | 200/302.2 |
| 6,559,752 | B1 | | 5/2003 | Sienkiewicz et al. | 337/53 |
| 6,674,034 | B1 | * | 1/2004 | Wang | 200/341 |
| 6,819,206 | B2 | | 11/2004 | Emura et al. | 335/17 |
| 2003/0160679 | A1 | * | 8/2003 | Yu | 337/37 |

* cited by examiner

TRIP-FREE MANUAL RESET THERMOSTAT

FIELD OF THE INVENTION

The present invention relates generally to a manual reset thermostat, and more particularly to a trip-free manual reset thermostat, which has a simple construction and is easy to manufacture.

BACKGROUND OF THE INVENTION

Manual reset thermostats are known in the art. Generally, the manual reset thermostats employ a bi-metal disc that snaps between opposite bowed positions, i.e., a concave position and a convex position, in response to a change in temperature, for closing and opening an electric circuit. The manual reset thermostats are normally closed and are snapped open when the bimetal snap disc reaches a predetermined temperature and flexes from a concave position to a convex position. The movement of the bi-metal disc pushes a movable contact away from a fixed contact to open the circuit. The bi-metal disc in a manual reset thermostat is usually so produced that the temperature at which it would automatically reset, namely, return to its normal concave position, is outside the range of temperatures expected in the environment in which the thermostat is intended to be used. Therefore, the bi-metal disc will not return to its normal concave position without manually resetting the switch. Generally, resetting a manual reset switch is achieved by depressing a reset element, for example, a pushbutton, to cause the bimetal snap disc to move back to its normal concave position and cause the movable contact to be in contact with the fixed contact, closing the electric circuit.

Manual reset thermostats with a trip-free mechanism do not permit the electric circuit to be closed upon manual reset if the bimetal disc has not reached a temperature below a predetermined temperature. A trip-free mechanism refers to a mechanism that cannot restrict the normal opening of a thermostat when a manual reset element, such as a pushbutton is depressed when the thermostat has not returned to a normal operating temperature. In other words, in a trip-free operation, the contacts must remain open with the manual reset element depressed and with the thermostat heated to at least an open or a limit temperature. Therefore, the trip-free mechanism serves as an important safety measure to prevent overriding of the designed temperature limit of the thermostat.

U.S. Pat. No. 3,675,178 to Place and assigned to Therm-O-Disc, Incorporated, the assignee of the present application, which is incorporated herein by reference in its entirety, discloses a manual reset thermostat with a trip-free mechanism. The manual reset thermostat includes a bi-metal disc, a pushbutton, and an actuating pin connected to the bi-metal disc for pushing the movable contact away from the fixed contacts when the bi-metal disc snaps open. These components must be precisely configured so that when the pushbutton is depressed, the top surface of the actuating pin engages the bottom surface of the pushbutton and stops the pushbutton from moving further to move the bi-metal disc to its reset position. Unless the temperature has dropped to the normal operating temperature, the bi-metal will not return to its reset position when the pushbutton is depressed.

The trip-free manual reset thermostats disclosed in the prior art, however, can be difficult to manufacture. For example, manual reset thermostats in the prior art rely on the dimensional interrelationship between the actuating pin, the pushbutton, and the bimetal disc, as well as the travel limitation on the pushbutton, to achieve the trip-free function. Given the narrow manufacturing and assembly tolerances that are required for an accurate interaction between these components, unnecessary time must be spent on gauging and match-fitting these finished components. Moreover, if the gauged components are unsuitable for the designed trip-free function, these components must be scrapped, thereby increasing the manufacturing costs.

SUMMARY OF THE INVENTION

In one aspect of this invention, a manual reset thermostat includes a first fixed contact and a second fixed contact for a normally closed circuit, and a bridging contact for connecting the first and the second fixed contacts in a normally closed position. The bridging contact has a first end opposing the first fixed contact and a second end opposing the second fixed contact. The manual reset thermostat includes a temperature responsive member for moving the bridging contact away from the first and the second fixed contacts when the temperature responsive member reaches a predetermined temperature, and a manually operable member movable between a released position and a depressed position. When the manually operable member is in the depressed position, the manually operable member presses the first end of the bridging contact against the first fixed contact, causing a pivotable movement of the bridging contact around the first end of the bridging contact so that the electric circuit is held open when the pushbutton is depressed.

In another aspect of this invention, a manual reset thermostat comprises two sets of a first fixed contact and a second fixed contact for two normally closed electric circuits. A pair of bridging contacts connect the respective one set of the first and the second fixed contacts in a normally closed position. Each of the bridging contacts has a first end adjacent to the respective one of the first fixed contacts and a second end adjacent to the respective one of the second fixed contacts. The manual reset thermostat further comprises a temperature responsive member and a manually operable member. The temperature responsive member moves the bridging contacts away from the fixed contacts when a temperature of the temperature responsive member reaches a predetermined temperature. Upon depressing the pushbutton, the pushbutton presses the first ends of the bridging contacts against the first fixed contacts and causes a pivotable movement of the bridging contacts around the first ends of the bridging contacts so that the electric circuits remain open when the pushbutton is depressed.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION OF THE PREFERRED EMBODIMENTS

Figure 1:
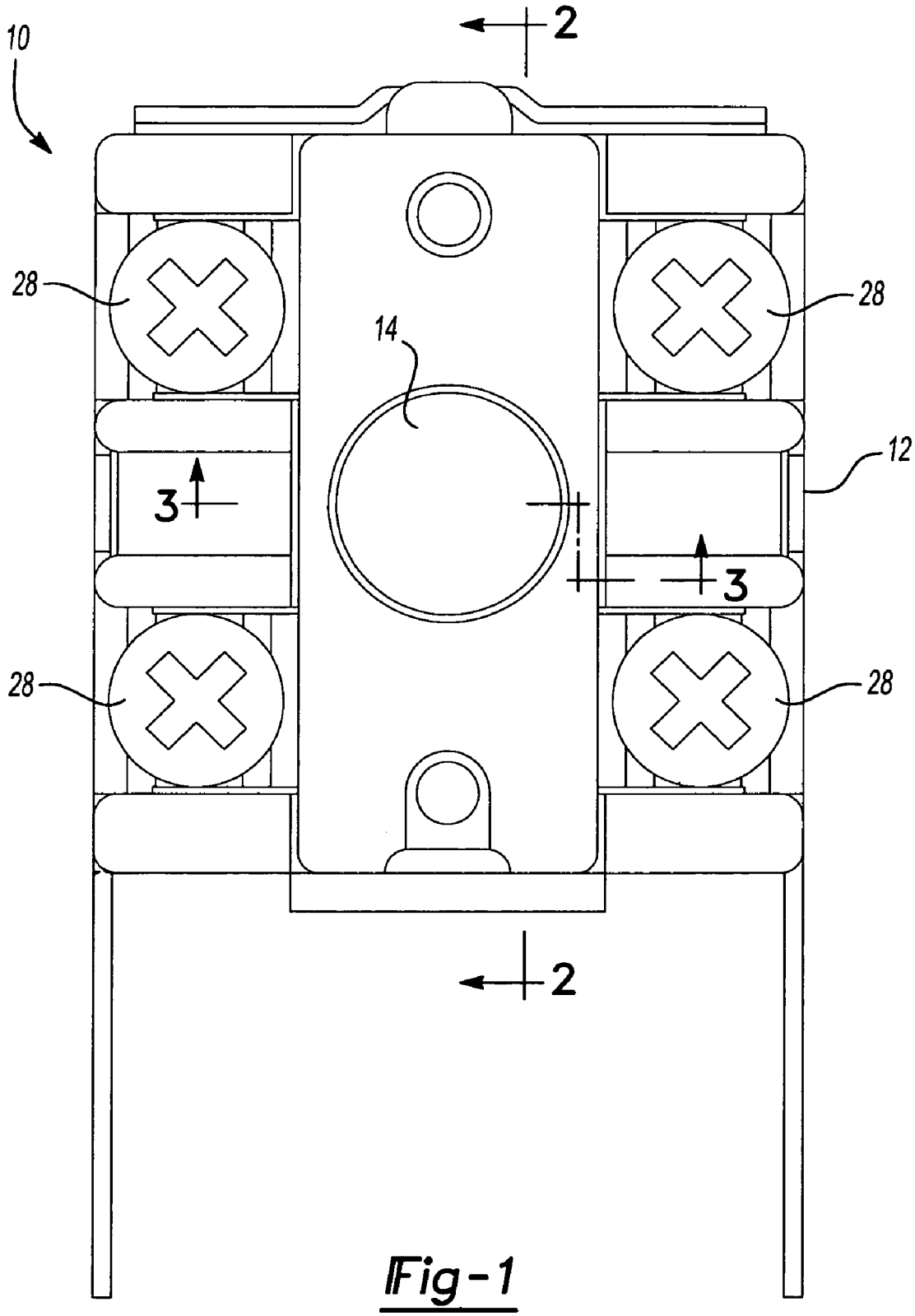
FIG. 1 is a plan view of a manual reset thermostat in accordance with the teachings of the present invention.

The structure of a trip-free manual reset thermostat in accordance with the present invention is now described in greater detail. The following description of the preferred embodiments is merely exemplary in nature and is in no way intended to limit the invention, its application, or uses.

Referring to FIGS. 1 to 4, a trip-free manual reset thermostat is illustrated and generally indicated by reference numeral 10. The trip-free manual reset thermostat 10 described and illustrated in this embodiment is used to control two electric circuits and comprises a housing 12, a pushbutton 14, an actuator 16 and a bi-metal snap disc 18. The pushbutton 14, the actuator 16 and the bi-metal snap disc 18 are received within the housing 12. The housing 12, the pushbutton 14 and the actuator 16 are formed of dielectric materials.

Figure 2:
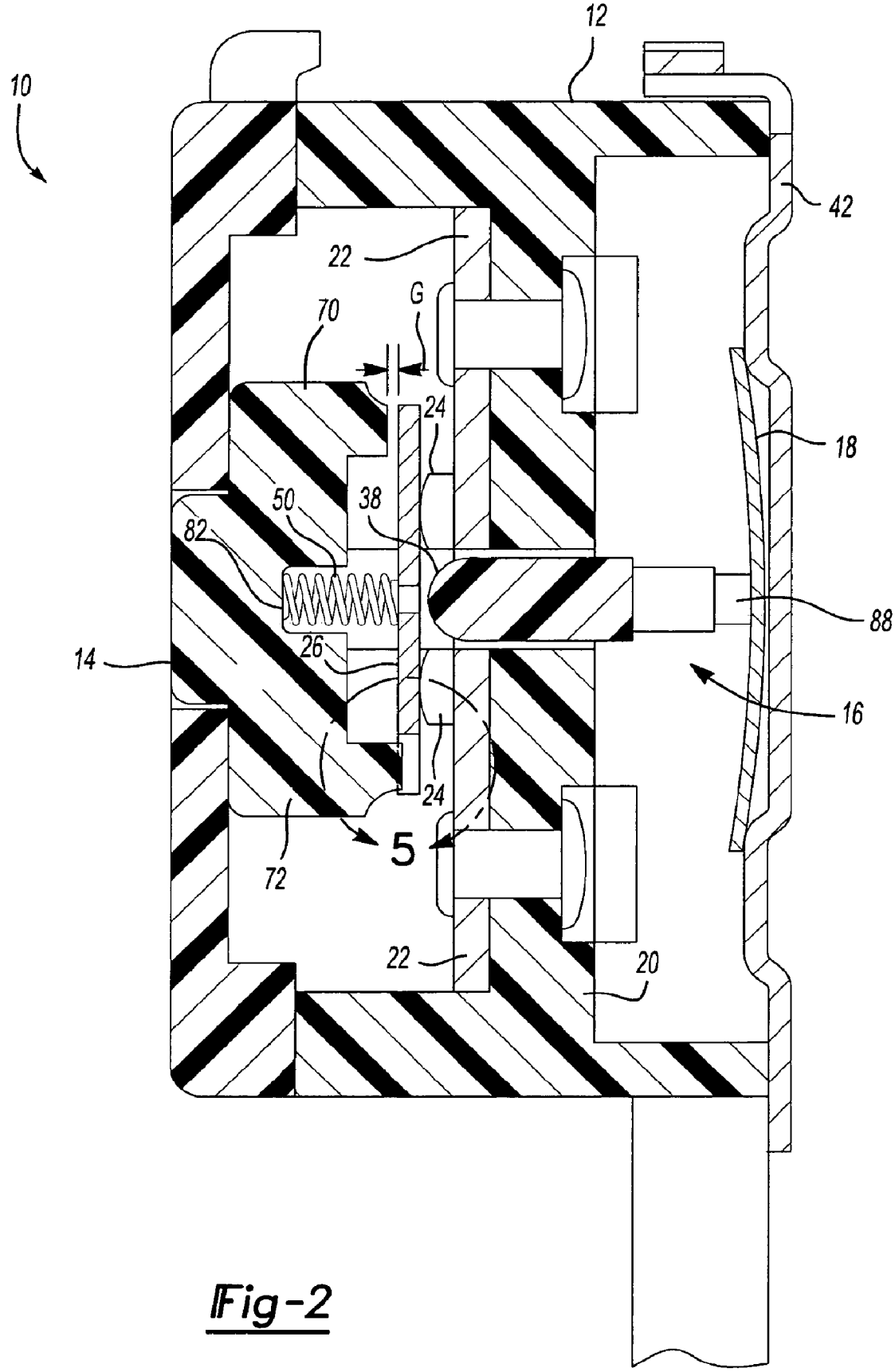
FIG. 2 is an enlarged cross-sectional view taken along line 2-2 of FIG. 1, showing the thermostat in its normally closed position where the pushbutton is in a released position and the bridging contacts are in contact with the fixed contacts.

As clearly shown in FIG. 2, the housing 12 has a wall 20 for supporting four terminals 22 (only two are shown in FIG. 2) of two electric circuits (not shown). A fixed contact 24 is provided at one end of each of the terminals 22 and is to be connected to an adjacent fixed contact 24 through a bridging contact 26. The terminals 22 extend out of the housing 12 and are provided with terminal screws 28 (shown in FIG. 1) for connection to external wiring circuits (not shown).

Figure 4:
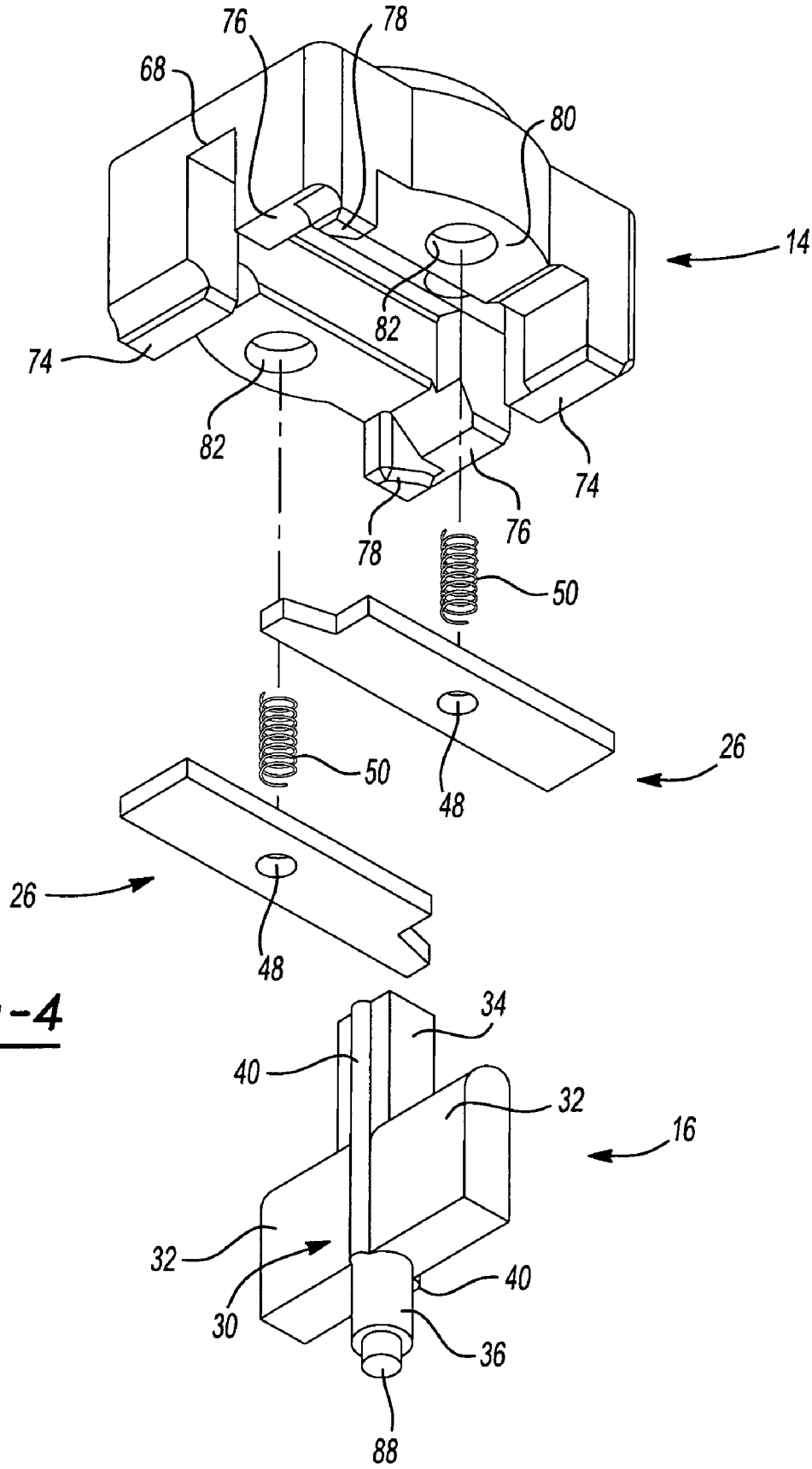
FIG. 4 is an exploded view of the manual reset thermostat of FIG. 1, showing the pushbutton, the springs, the bridging contacts, and the actuator.
Figure 6:
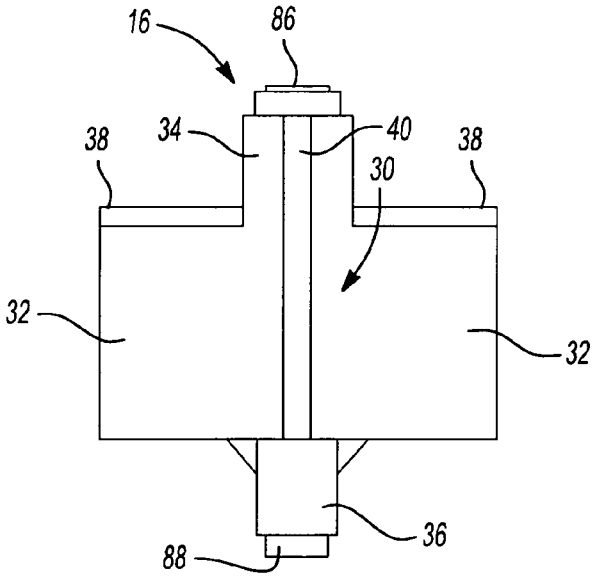
FIG. 6 is a front view of the actuator.
Figure 7:
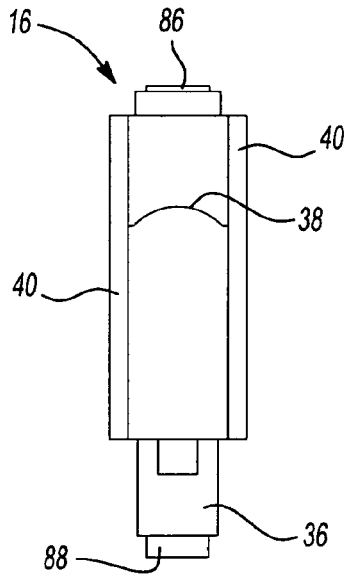
FIG. 7 is a side view of the actuator.

Referring to FIGS. 4, 6 and 7, the actuator 16 has a central portion 30 and a pair of lateral portions 32 extending laterally from the central portion 30 in opposite directions. The central portion 30 includes an upper extension 34 and lower extension 36 for engaging the pushbutton 14 and the bi-metal snap disc 18, respectively. The lateral portions 32 each have a rounded top surface 38 for supporting the respective one of the bridging contacts 26 thereon. The central portion 30 includes a pair of guiding posts 40 extending along the longitudinal direction of the central portion 30. The guiding posts 40 are inserted into corresponding guiding recesses (not shown) formed in the housing 12 to allow for smooth movement of the actuator within the housing 12.

The bi-metal snap disc 18 engages a bottom end 88 of the lower extension 36 of the actuator 16. The bi-metal snap disc 18 is supported by a metal back plate 42. The bi-metal snap disc 18 is in a generally concave shape as shown in FIG. 2 when the manual reset thermostat 10 is in its normal operating condition. The operation of the bi-metal snap disc 18 will be described later.

Figure 8:
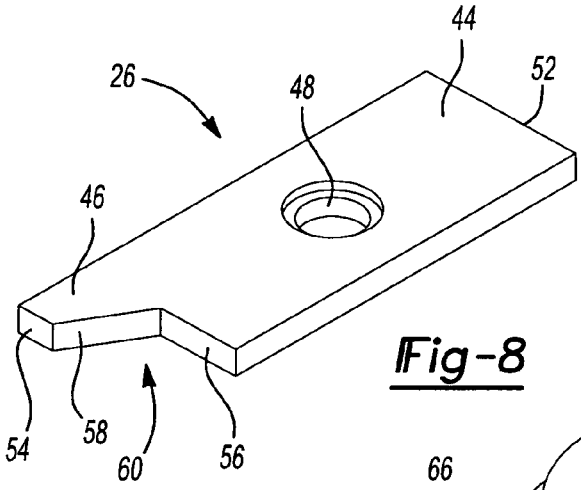
FIG. 8 is a perspective view of the bridging contact.

Referring to FIGS. 4 and 8, the bridging contacts 26 each extend across the adjacent two fixed contacts 24 for controlling closing and opening of the circuits by connecting or disconnecting the adjacent two fixed contacts 24. The bridging contacts 26 are of an elongated shape and each include a main body portion 44 and a narrowed portion 46. The main body portion 44 defines a retaining portion for retaining a lower end of a spring 50 on the bridging contact 26. In this illustrative embodiment, the retaining portion defines a recess 48 for receiving the lower end of the spring 50. The retaining portion can be formed as any fasteners known in the art, such as screws, bolts and hooks, etc., for retaining the spring 50 on the bridging contact 26.

The bridging contacts 26 have a first end 52 and an opposing second end 54 in the longitudinal direction of the elongated bridging contact 26. The first end 52 is located at the main body portion 44 while the second end 54 is located at the narrowed portion 46. The main body portion 44 has a transverse edge 56 adjacent to the narrow portion 46. The narrowed portion 46 has a longitudinal edge 58 meeting the transverse edge 56. The longitudinal edge 58 can form an obtuse angle relative to the transverse edge 56 as shown in FIG. 7. The transverse edge 56 and the longitudinal edge 58 define a cutout portion 60. It should be noted that the cutout portion 60 does not have to be defined by two straight lines as shown in FIG. 8 and can be of any shape. For example, the cutout portion 60 can be defined by a curve or can be formed as a hole.

The bridging contacts 26 are of a length longer than the distance between the adjacent fixed contacts 24. At least the first end 52 of the bridging contact 26 extends outwardly of the adjacent one of the fixed contacts 24 in a longitudinal direction defined by the fixed contacts 24.

Figure 9:
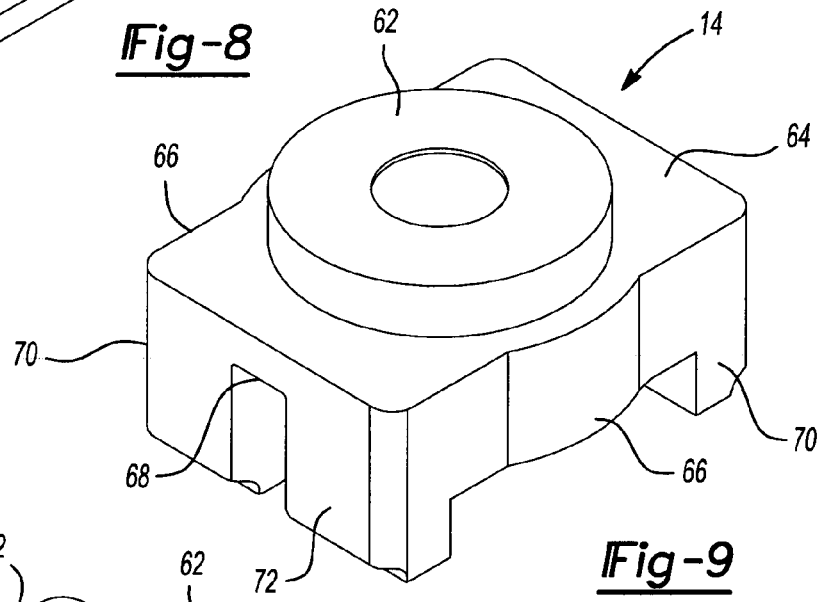
FIG. 9 is a top perspective view of the pushbutton.
Figure 10:
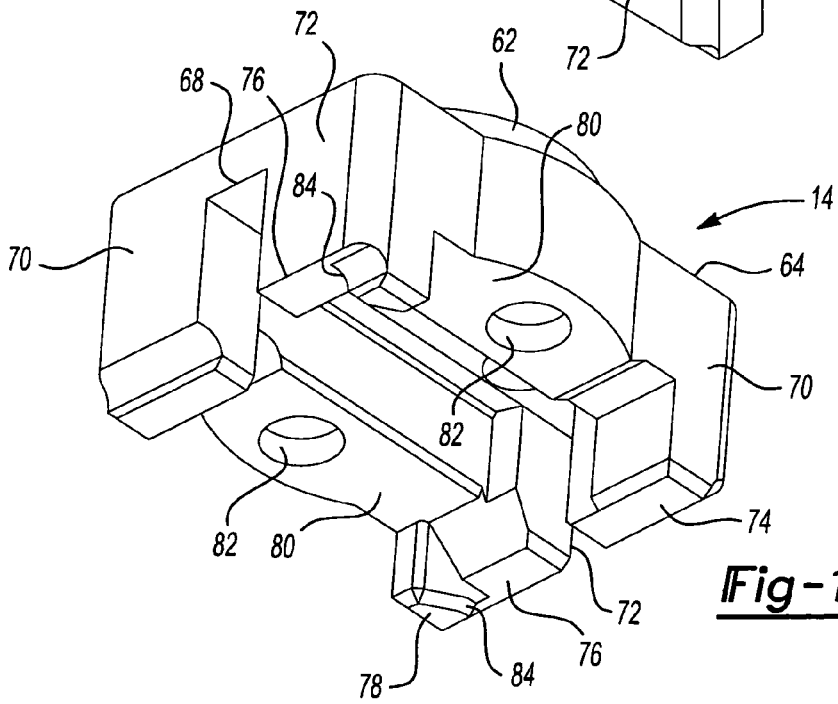
FIG. 10 is a bottom perspective view of the pushbutton.

Referring to FIGS. 9 and 10, the pushbutton 14 has a rounded projection 62 and a main body portion 64. The main body 64 defines a substantially rectangular shape and includes two halves 66 each for controlling one electric circuit. The two halves 66 are separated by the engaging surface 68, which engages the upper extension 34 of the actuator 16 when the pushbutton 14 is depressed.

Each of the halves 66 has a first leg 70 and a second leg 72 extending downwardly from the main body portion 64. The first legs 70 have a flat surface 74 for contacting the first end 52 of the bridging contact 26. The second legs 72 have a flat surface 76 and a projection 78 extending downwardly from the flat surface 76. The first legs 70 and the second legs 72 are so arranged that they are disposed above the bridging contact 26 and adjacent to the first end 52 and the second end 54, respectively. The first leg 52 and the second leg 54 in the same half 66 are separated by a recessed portion 80, which is formed with a retaining means opposing the recess 48 of the bridging contact 26. In this illustrative embodiment, the retaining means of the recessed portion 80 defines a counterbore 82. The counterbore 82 of the recessed portion 80 and the recess 48 of the bridging contact 26 cooperatively retain the spring 50 between the pushbutton 14 and the bridging contacts 26. It should be noted that the retaining means of the recessed portion 80 can be formed as any fasteners known in the art, such as screws, bolts, hooks, recesses and holes, etc., for retaining the spring 50 between the bridging contact 26 and the pushbutton 14 without departing from the spirit of this invention.

The flat surface 76 and the projection 78 of the second leg 72 define a shoulder 84, as clearly shown in FIG. 10. The shoulder 84 defines a space to allow for a pivotable movement of the narrowed portion 46 of the bridging contact 26 around the first end 52 as the pushbutton 14 is depressed, which will be described later.

In this illustrative embodiment, the first legs 70 are shown to be disposed in one diagonal axis of the pushbutton 14 and the second legs 72 are shown to be disposed in another diagonal axis. In other words, two halves 66 are arranged in an asymmetric manner relative to the engaging surface 68. However, the halves 66 can be arranged in a symmetric manner relative to the engaging surface 68 without departing from the spirit of the present invention.

Figure 5:
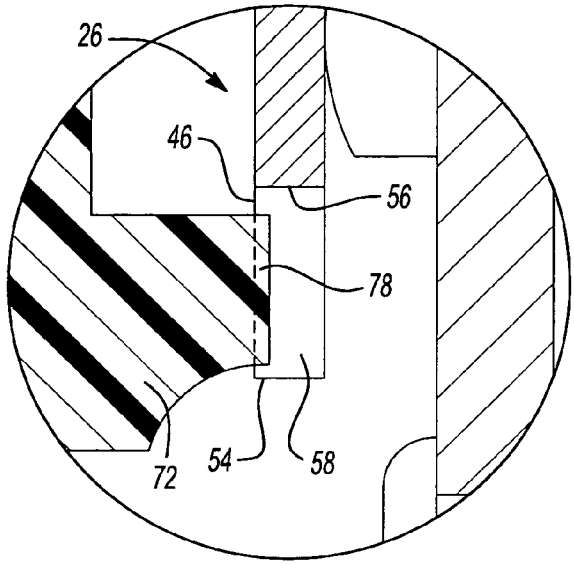
FIG. 5 is an enlarged view of the manual reset thermostat, within detail A of FIG. 2, showing the positional relationship between the pushbutton and the bridging contact.

Referring back to FIGS. 2 and 5, when the pushbutton 14 is assembled to the housing 12 and in a released position, the first legs 70 and the second legs 72 are disposed immediately above the first end 52 and the second end 54 of the respective one of the bridging contacts 26. The first legs 70 are so configured that when the thermostat 10 is in its normal operating condition, a gap G is formed between the flat surfaces 74 of the first legs 70 and the first ends 52 of the bridging contacts 26. The second legs 72 and the bridging contacts 26 are so configured that the narrowed portions 46 of the bridging contacts 26 are disposed immediately below the flat surfaces 76 of the second legs 72 with the projections 78 of the second legs 72 facing the cutout portions 60 of the bridging contacts 26.

Figure 3:
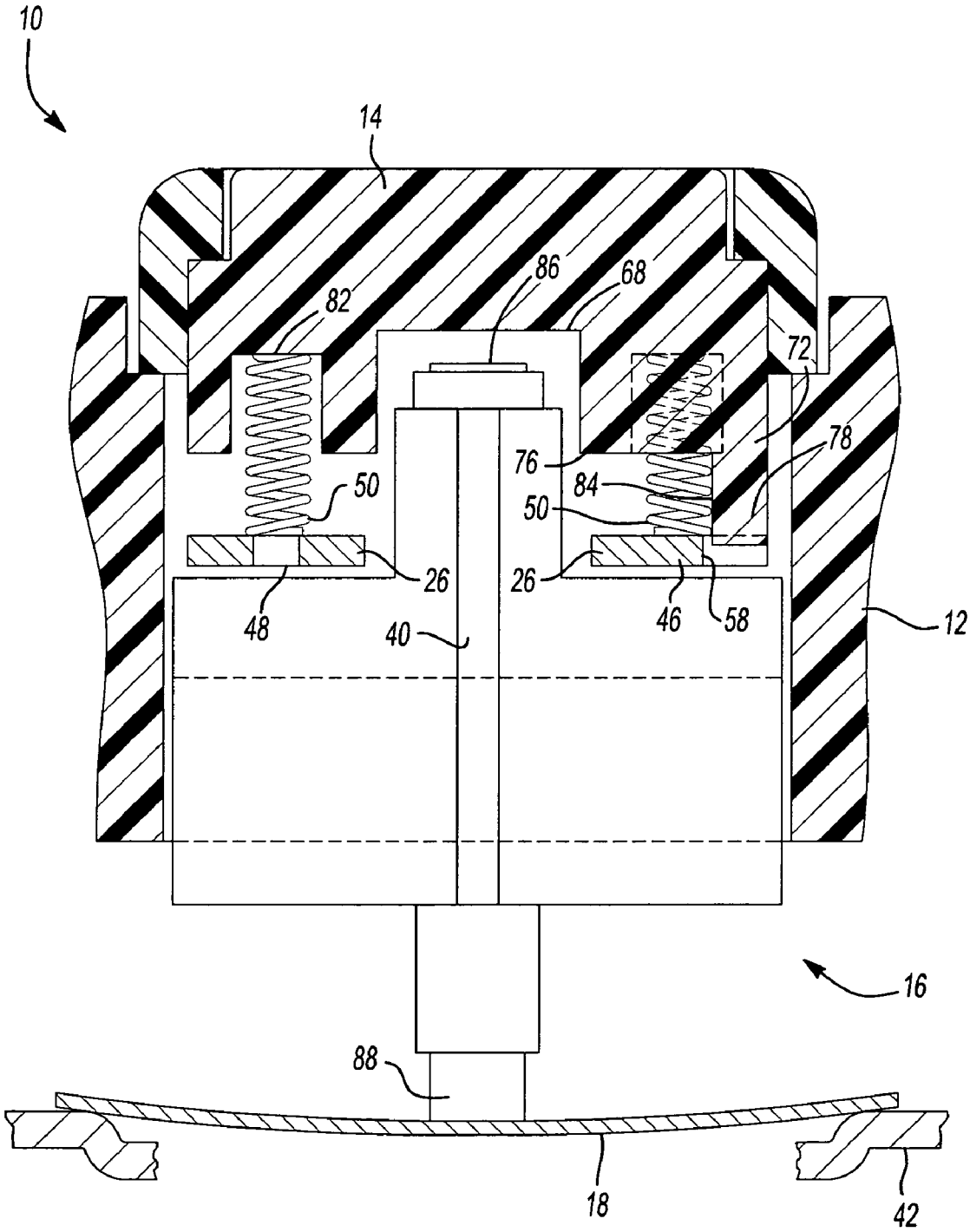
FIG. 3 is a fragmentary cross-sectional view taken along line 3-3 of FIG. 1.
Figure 11:
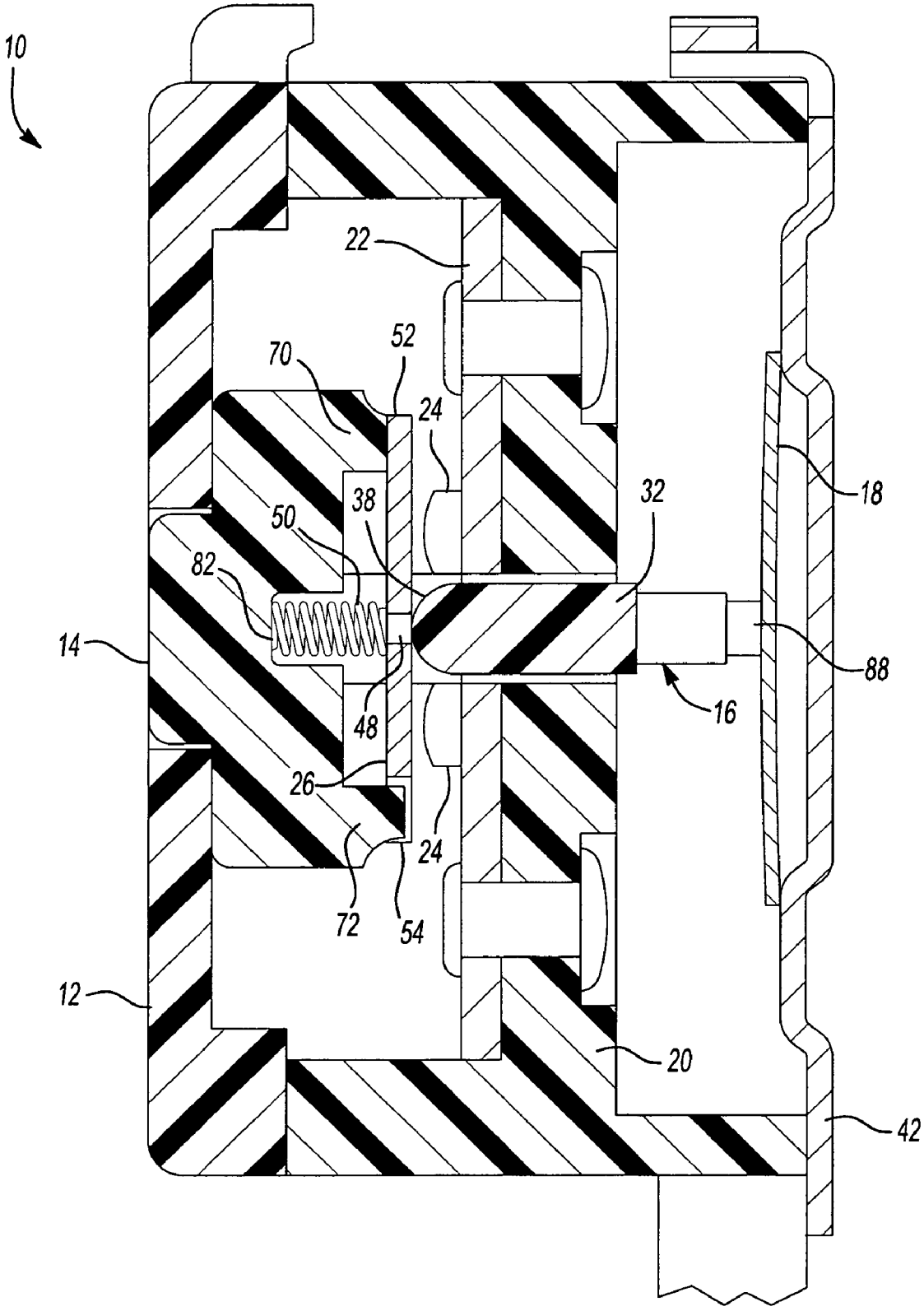
FIG. 11 is a view similar to FIG. 2, showing the thermostat in its switch open position where the bridging contacts are pushed away from the fixed contacts by the bimetal snap disc and the pushbutton is in a released position.
Figure 12:
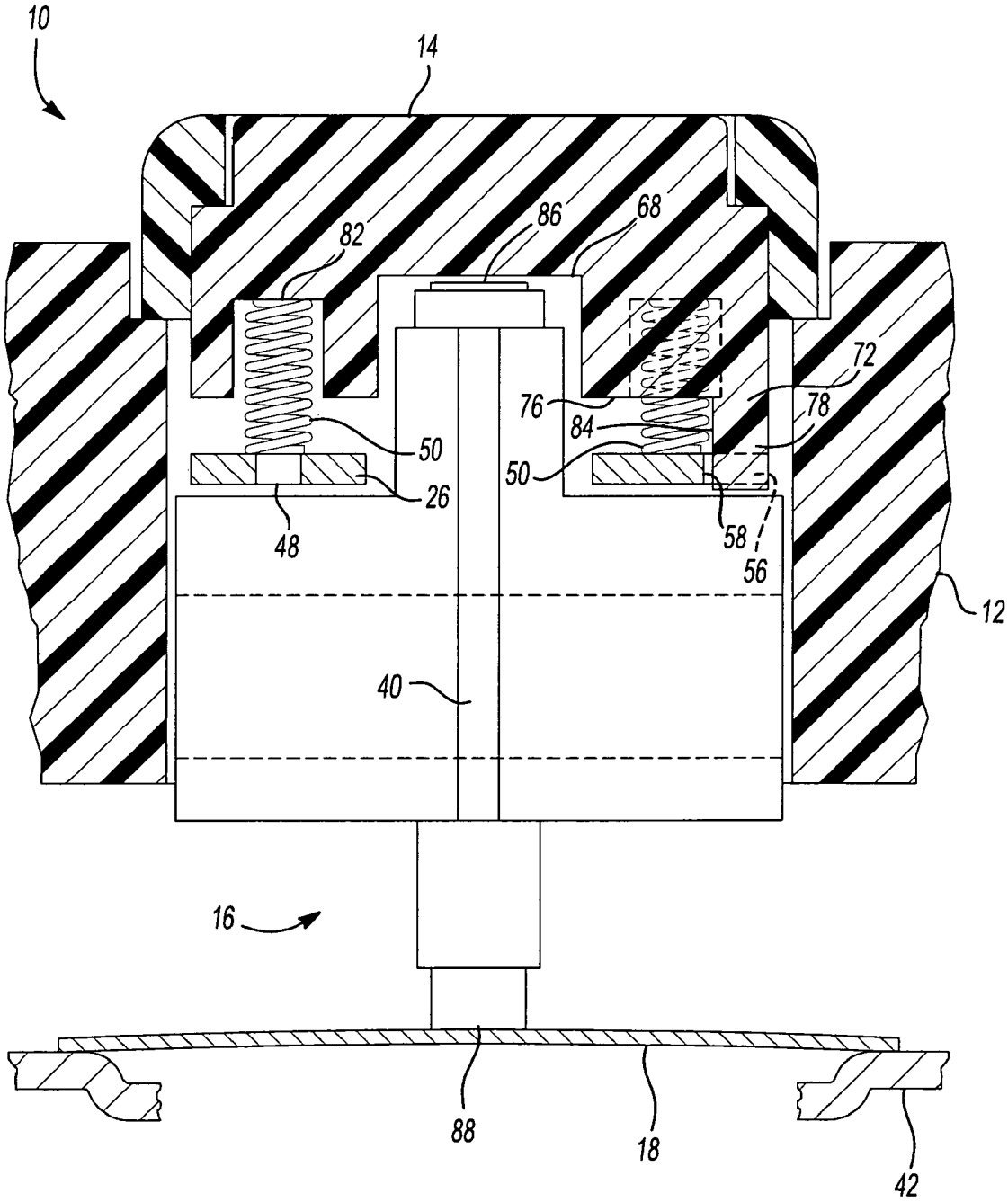
FIG. 12 is a view similar to FIG. 3, showing the thermostat in its switch open position where the bridging contacts are pushed away from the fixed contacts by the bimetal snap disc and the pushbutton is in a released position.
Figure 13:
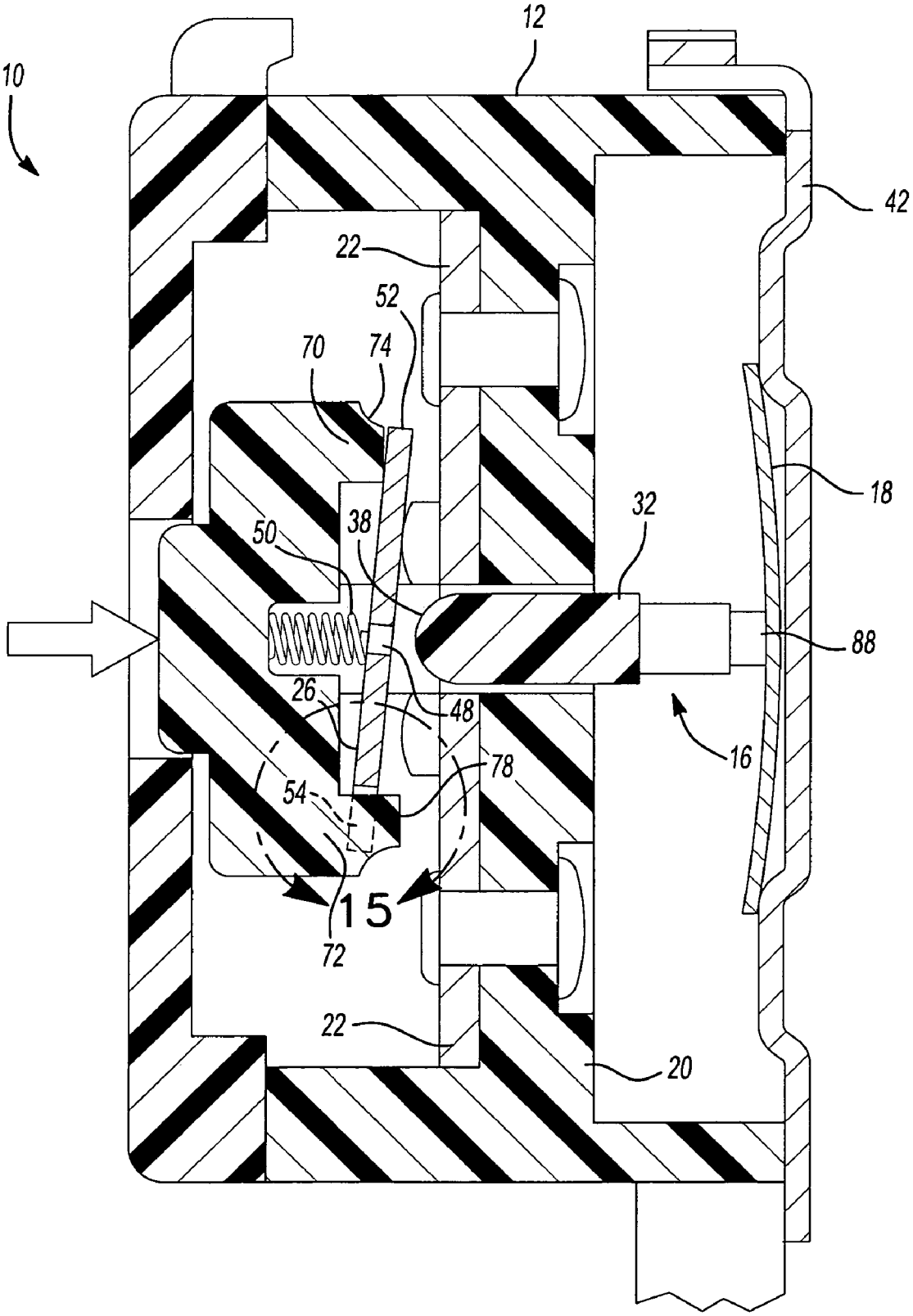
FIG. 13 is a view similar to FIG. 2, showing the thermostat in its held-open position where the pushbutton is in a depressed position and the bridging contacts are pivoted to keep the circuits open.

Referring to FIGS. 2, 3, 5 and 11 to 15, when the thermostat 10 is in its normally closed state as shown in FIGS. 2 and 3, the bridging contacts 26 and the adjacent fixed contacts 24 are in contact to close the respective one of the electric circuits (not shown) and the bi-metal disc 18 is in a downwardly bowed concave position. When the thermostat 10 reaches a predetermined or limit temperature, the bi-metal disc 18 snaps through to its opposite position of curvature as shown in FIGS. 11 and 12. This snap action of bi-metal disc 18 forces the actuator 16, and hence the bridging contacts 26, to move upwardly against the biasing force of the spring 50 to a switch-open position, namely, the bridging contacts 26 are pushed away from the fixed contacts 24 and the circuits are pushed open. The gap G (shown in FIG. 2) formed between the first leg 70 of the pushbutton 14 and the first end 52 of the bridging contact 26 allows the adjacent bridging contact 26 to move up without being obstructed until the first end 52 of the bridging contact 26 reaches the flat surface 74 of the first leg 70. Because the narrowed portion 46 of the bridging contact 26 is disposed below the space defined and adjacent to the shoulder 84 and the projection 78 is located above the cutout portion 60 of the bridging contact 26, the movement of the second end 54 of the bridging contact 26 is not obstructed.

Figure 14:
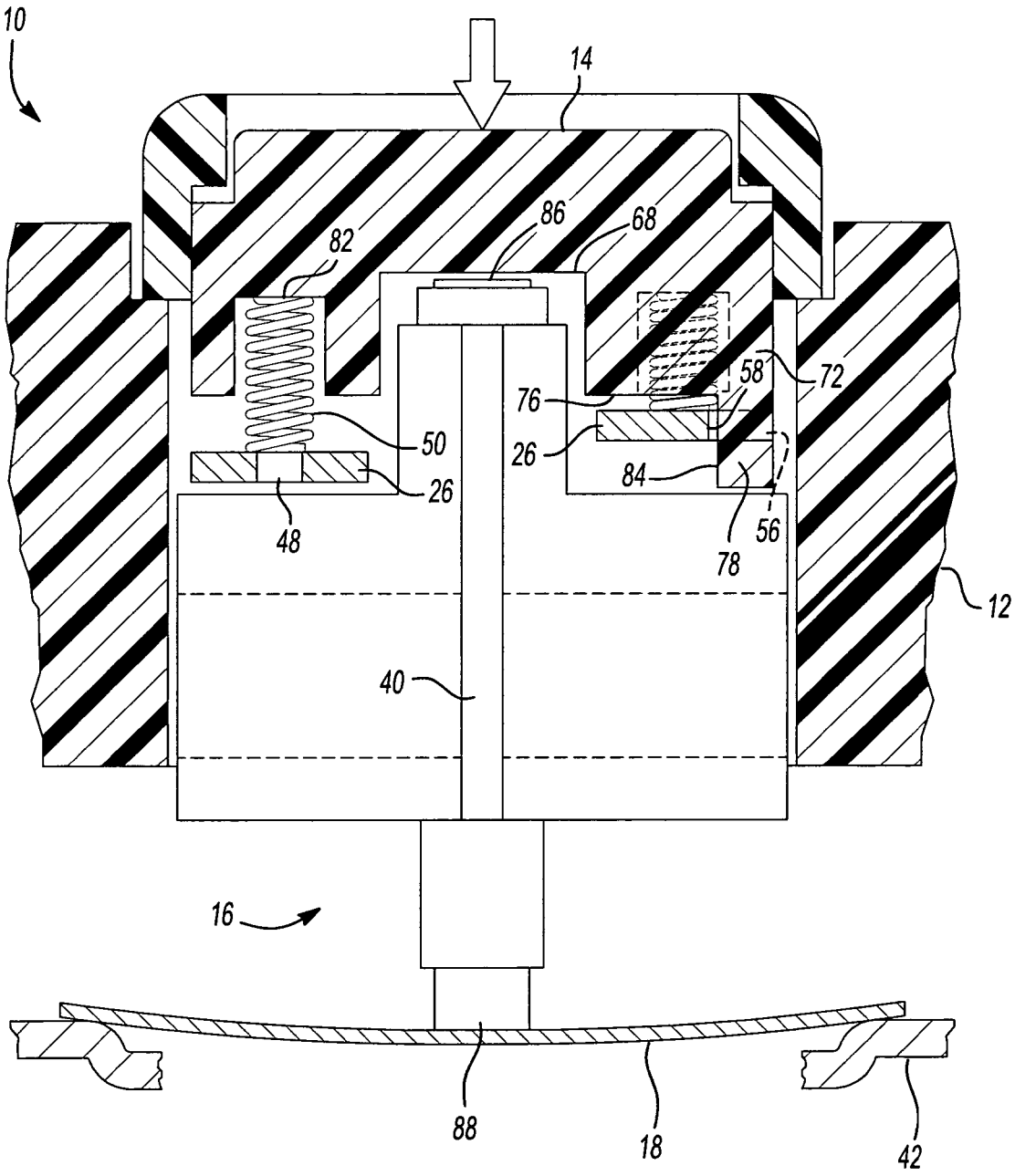
FIG. 14 is a view similar to FIG. 3, showing the thermostat in its held-open position where the pushbutton is in a depressed position and the bridging contacts are pivoted to keep the circuit open.
Figure 15:
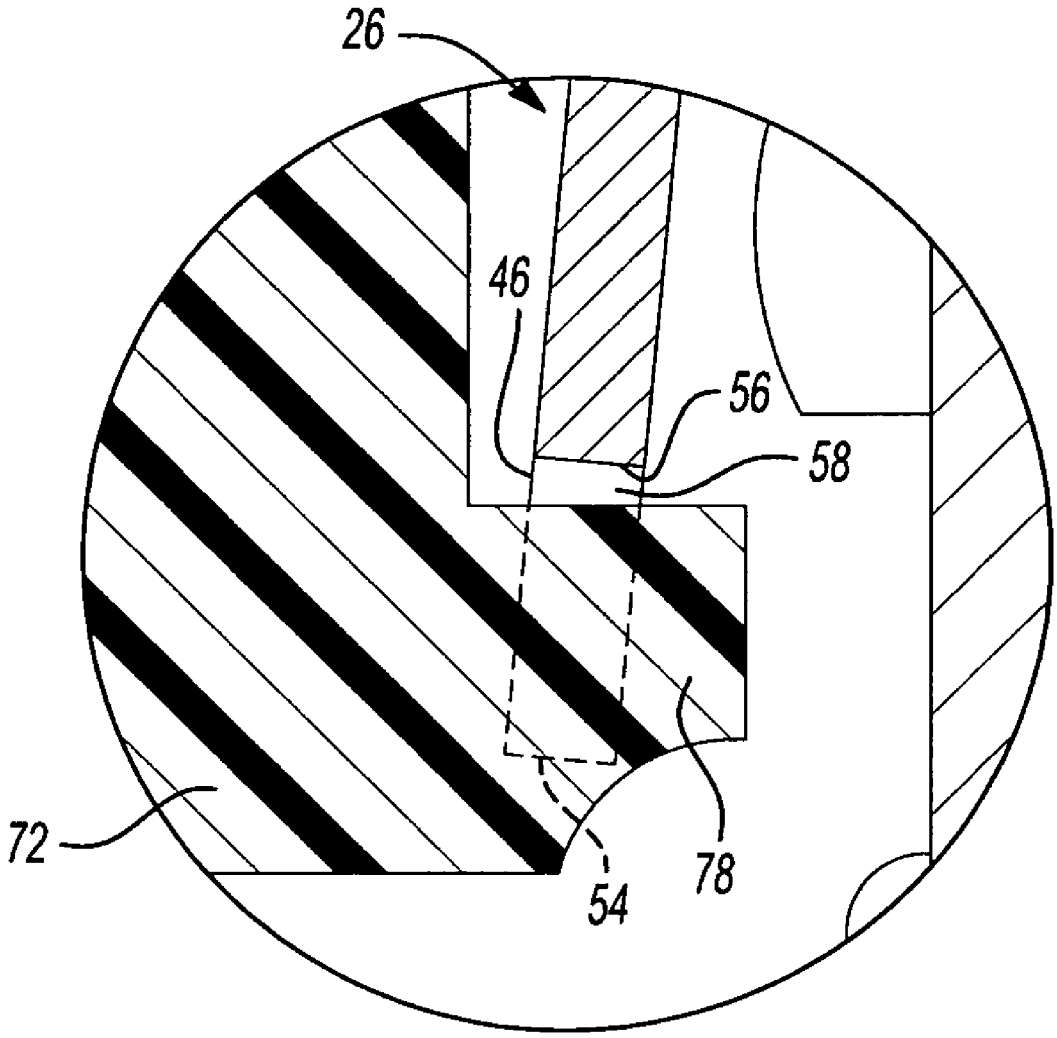
FIG. 15 is an enlarged view of the manual reset thermostat, within detail B of FIG. 13, showing the positional relationship between the pushbutton and the bridging contact.

The bi-metal snap disc 18 remains in its switch-open position until the pushbutton 14 is manually depressed, causing engagement between the engaging surface 68 of the pushbutton 14 and a top end 86 of the actuator 16 and engagement between the bottom end 88 of the actuator 16 and the bimetal snap disc 18 as shown in FIG. 14. When this engagement occurs, continued depressing of the pushbutton 14 causes the actuator 16 to press the first end 52 of the bridging contact 26 against the adjacent fixed contact 24, thereby causing pivotal movement of the bridging contact 26 around the first end 52. The narrowed portion 46 of the bridging contact 26 moves upwardly toward the space defined by and adjacent to the shoulder 84 without being obstructed, as clearly shown in FIGS. 14 and 15. As a result, the electric circuits are held open when the pushbutton 14 is in a depressed position. Resetting of the thermostat, then, cannot occur until the bi-metal snap disc 18 returns to a temperature in which it will remain in the reset or the normal operating position, since release of the pushbutton 14 before such temperature is reached would merely allow the disc 18 to snap back to the switch open position where the bi-metal disc 18 pushes the bridging contacts 26 away from the fixed contacts 24.

The trip-free mechanism used in this invention does not rely on the dimensional relationship among the pushbutton 14, the actuator 16, and the bi-metal snap disc 18 for its effective performance of the trip-free function, i.e., the pushbutton 14 does not restrain the circuit from opening when the temperature is not lowered to a normal operating temperature. This invention ensures the occurrence of the trip-free function by using the first end 52 of the bridging contact 26 as a pivot point so that the second end 54 of the bridging contact 26 will be caused to move away from the adjacent fixed contact 24 when the pushbutton 14 is in the depressed position. Therefore, this invention provides a simple construction and is easy to manufacture, thereby reducing the manufacturing costs.

The manual reset thermostat 10 described in the illustrative embodiment is a Manually Reset 2 (M2) thermostat which refers to a switch holding electric circuits open when the manual reset element, e.g., a pushbutton, is in a depressed position, even if the temperature has returned to a normal operating temperature. In contrast, the manual reset thermostat disclosed in U.S. Pat. No. 3,675,178 is a Manually Reset 1 (M1) switch which refers to a switch which does not keep the electric circuit open when the pushbutton is in the depressed position if the temperature has returned to a normal operating temperature. This invention can be interchangeably used as an M1 or an M2 switch by simply replacing the pushbutton 14 and the bridging contacts 26.

It should be noted that while in the illustrative embodiment, the narrowed portions 46 of the bridging contacts 26 are provided at the inner side of the projection 78 of the second leg 72, the narrowed portion 46 can be provided at the outer side of the projection 78 as long as the narrowed portion 46 is made to face the space defined by the shoulder 84 and the projection 78 is made to face the cutout portion 60 of the bridging contact 26.

Moreover, it should be noted that while the manual reset thermostat 10 has been described to be used for a two-pole switch, i.e., a switch controlling two circuits, the manual reset thermostat 10 of this invention can be used as a one-pole thermostat by providing only one bridging contact and two fixed contacts without departing from the spirit of the present invention.

It should also be noted that while the manual reset thermostat/switch 10 is used to control temperature, the manual reset switch 10 can be used to control, for example, pressure, by replacing the bi-metal snap disc 18 with a pressure responsive member without departing from the spirit of the present invention.

The description of the invention is merely exemplary in nature and, thus, variations that do not depart from the gist of the invention are intended to be within the scope of the invention. Such variations are not to be regarded as a departure from the spirit and scope of the invention.

What is claimed is:

1. A manual reset thermostat, comprising:

a first fixed contact and a second fixed contact;

a bridging contact electrically connecting the first and the second fixed contacts in a normally closed position, the bridging contact having a first end and a second end, the second end comprising a narrowed portion defining a cutout portion;

a temperature responsive member for moving the bridging contact away from the first and the second fixed contacts when the temperature responsive member reaches a predetermined temperature; and a manually operable member movable between a released position and a depressed position, the manually operable member comprising a first leg and a second leg, the second leg comprising a flat surface and a projection that define a shoulder;

wherein the narrowed portion of the second end of the bridging contact is located adjacent to the flat surface of the second leg of the manually operable member and the cutout portion of the second end of the bridging contact is located adjacent to the projection of the second leg of the manually operable member, such that pivotal movement of the second end of the bridging contact about its first end that results from the depression of the manually operable member is not obstructed.

2. A manual reset thermostat, comprising:

a first electrical contact and a second electrical contact for an electric circuit;

a bridging contact electrically connecting the first and the second contacts in a normally closed position, the bridging contact having a first end portion and a second end portion for respectively engaging the first electrical contact and the second electrical contact, the second end portion comprising a narrowed portion;

a temperature responsive member operable to disengage the bridging contact from the first and the second electrical contacts at a predetermined temperature;

a pushbutton movable between a released position and a depressed position, the pushbutton comprising at least two legs, and one of the legs comprising a shoulder portion; and wherein when the pushbutton is in the depressed position, a first leg of the pushbutton biases the first end portion of the bridging contact against the first electrical contact and causes the second end portion of the bridging contact to pivot about the first end portion of the bridging contact and the narrowed portion of the second end portion to be received in the shoulder portion of the pushbutton such that the second end portion of the bridging contact cannot engage the second electrical contact.

3. A manual reset thermostat, comprising:

a first fixed contact and a second fixed contact;

a bridging contact electrically connecting the first and the second fixed contacts in a normally closed position, the bridging contact having a first end and a second end, the second end comprising a cutout portion;

a temperature responsive member for moving the bridging contact away from the first and the second fixed contacts when the temperature responsive member reaches a predetermined temperature; and a manually operable member movable between a released position and a depressed position, the manually operable member comprising a first leg and a second leg, the second leg comprising a shoulder;

wherein depression of the manually operable member causes the first leg of the manually operable member to bias the first end of the bridging contact against the first fixed contact, the second end of the bridging contact to pivot about the first end of the bridging contact, and the cutout portion of the second end of the bridging contact moves past the shoulder of the second leg of the manually operable member.

4. The manual reset thermostat of claim 3, wherein the bridging contact is disposed along a longitudinal direction defined by the first and the second fixed contacts and the first end of the bridging contact extends outwardly of the first fixed contact in the longitudinal direction.

5. The manual reset thermostat of claim 3, wherein the first leg has a flat surface for contacting the first end of the bridging contact.

6. The manual reset thermostat of claim 5, wherein a gap is formed between the flat surface and the first end of the bridging contact to allow for movement of the bridging contact caused by the temperature responsive member.

7. The manual reset thermostat of claim 3, wherein the temperature responsive member includes a bi-metal disc.

8. The manual reset thermostat of claim 3, further comprising a biasing device for biasing the bridging contact to the normally closed position when the manually operable member is moved from the depressed position to the released position, when the temperature responsive member is below the predetermined temperature.

9. The manual reset thermostat of claim 8, wherein the biasing device is disposed between the manually operable member and the bridging contact.

10. The manual reset thermostat of claim 9, wherein the manually operable member and the bridging contact each define a retaining portion for cooperatively retaining the biasing device between the manually operable member and the bridging contact.

11. The manual reset thermostat of claim 10, wherein the retaining portions of the manually operable member and the bridging contact each define a recess for receiving opposing ends of the biasing device.

12. The manual reset thermostat of claim 3, wherein the manually operable member includes a pushbutton.

13. The manual reset thermostat of claim 3, wherein the bridging contact is made of resilient conductive material.

14. The manual reset thermostat of claim 3, wherein the bridging contact has a length longer than the distance between the first and the second fixed contacts.

15. The manual reset thermostat of claim 3, further comprising a housing for receiving the manually operable member, the fixed contacts, the bridging contact and the temperature responsive member therein.

* * * * *